US005987778A

United States Patent [19]

Stoner

[11] Patent Number: 5,987,778

[45] Date of Patent: Nov. 23, 1999

[54] PROTECTIVE FOOTWEAR AND LOWER LEG COVERING

[76] Inventor: Ronald N. Stoner, 3009 Colonial Dr., Charlottesville, Va. 22911

[21] Appl. No.: 09/013,189

[22] Filed: Jan. 26, 1998

Related U.S. Application Data

[60] Provisional application No. 60/036,313, Jan. 30, 1997.

[51] Int. Cl.[6] ..... A43B 3/20; A43B 3/16; A43B 23/02; A41D 17/00

[52] U.S. Cl. ..... 36/1.5; 36/2 R; 36/96; 36/109; 36/72 R; 36/7.2

[58] Field of Search ..... 36/1.5, 2 B, 2 R, 36/96, 109, 7.1 R, 7.2, 72 R

[56] References Cited

U.S. PATENT DOCUMENTS

| | | | |
|---|---|---|---|
| D. 210,190 | 2/1968 | Garcia . | |
| D. 281,739 | 12/1985 | Hazley . | |
| D. 306,921 | 3/1990 | Pettinelli . | |
| D. 322,354 | 12/1991 | Tully . | |
| D. 341,475 | 11/1993 | Ikezawa . | |
| D. 354,615 | 1/1995 | Parker . | |
| D. 365,667 | 12/1995 | Hargrove et al. . | |
| 2,872,745 | 2/1959 | Finegan | 36/7.1 R |
| 3,250,025 | 5/1966 | Crescent | 36/1.5 |
| 3,921,313 | 11/1975 | Mahide et al. . | |
| 4,010,558 | 3/1977 | Slusher . | |
| 4,057,853 | 11/1977 | McLane . | |
| 4,599,812 | 7/1986 | Harmsen . | |
| 4,713,895 | 12/1987 | Vallieres | 36/1.5 |
| 4,896,438 | 1/1990 | DeBease | 36/7.1 R |
| 4,967,491 | 11/1990 | Plotkin . | |
| 5,144,759 | 9/1992 | Mascotte | 36/71 R |
| 5,165,182 | 11/1992 | Michael | 36/1.5 |
| 5,170,503 | 12/1992 | Hightower, Jr. et al. . | |
| 5,311,676 | 5/1994 | Hughes et al. . | |
| 5,337,491 | 8/1994 | Mascotte . | |
| 5,469,637 | 11/1995 | Adam . | |
| 5,600,901 | 2/1997 | Leonor | 36/7.1 R |
| 5,845,416 | 12/1998 | Hands | 36/2 R |

FOREIGN PATENT DOCUMENTS

| | | |
|---|---|---|
| 0411524 | 2/1991 | European Pat. Off. . |
| 2103069 | 2/1983 | United Kingdom . |
| 2226943 | 7/1990 | United Kingdom . |
| 2245477 | 1/1992 | United Kingdom . |
| WO 96/15691 | 5/1996 | WIPO . |

*Primary Examiner*—Paul T. Sewell
*Assistant Examiner*—Anthony Stashick
*Attorney, Agent, or Firm*—Richard C. Litman

[57] ABSTRACT

A protective footwear and lower leg covering protects the shoes and lower trousers or legs of a wearer while using a mower, string trimmer, chain saw, or other equipment which may discharge objects at high speed. The covering also serves to protect the user's shoes and clothing during painting operations, and the complete closure from the sole of the shoe upward along the lower leg, also serves to protect the wearer from insect bites and stings. The device comprises a molded plastic, rubber, or other elastomer shoe or boot cover, which is sewn to an upper legging, spat or puttee configured to cover bare or trousered legs. A plurality of fastening straps secure the protective cover to a wearer's foot and lower leg. The shoe or boot cover has no sole, thus providing for easier donning by a wearer. The shoe or boot cover is secured to the shoe or boot by a strap which passes beneath the sole, or alternatively by a toe pocket or hold formed in the forward end of the cover. The legging portion may include a knee pad extending upwardly therefrom, for greater utility and versatility for the device. At least the shoe or boot cover portion is symmetrically formed, to provide a universal fit to both the left and right shoes or boots of the wearer, without regard for specific fit to either the left or right shoe or boot.

6 Claims, 5 Drawing Sheets

PROTECTIVE FOOTWEAR AND LOWER LEG COVERING

REFERENCE TO RELATED PATENT APPLICATION

This application claims the benefit of U.S. Provisional patent application Ser. No. 60/036,313 filed on Jan. 30, 1997.

BACKGROUND OF THE INVENTION

1. Field of the Invention

The present invention relates generally to protective apparel for the lower legs and feet, and more specifically to a protective cover which can be worn over shoes or boots, and which protects the wearer's footwear and lower legs. The cover is universal, in that it may be applied to either the left or right leg and foot without need for specifically formed shapes for the left or right foot.

2. Introduction and Description of the Prior Art

There are many occasions when a person's lower legs and footwear are exposed to conditions which may cause injury to the person and/or damage to expensive footwear and clothing. For example, when operating a lawn mower, grass clippings and other debris are hurled at the feet and lower legs, possibly staining the pant legs. Also, operating a string trimmer is especially hazardous because of the exposed rotating cutting string. Even with a guard, the exposed cutting string has been known to occasionally hit the lower leg of the operator of the string trimmer, thus causing injury to the operator's leg.

Operating a chain saw may also be hazardous, due to the saw dust and debris generated by the saw. Such debris can travel at high velocities and may impact the lower legs of the chain saw operator. Further, the chain saw blade itself may hit the lower legs or feet of the operator, with the potential for severe injury. When painting, paint may splatter on expensive shoes, boots, and clothing, thus ruining such items. Also the lower leg area is prone to insect bites during outdoor activities, even when long pants are worn. For these reasons, many leg protectors have been proposed in the prior art. A discussion of the related art of which the inventor is aware, and its differences and distinctions from the present invention, is provided immediately below.

U.S. Pat. No. 3,921,313, issued to Buhei Mahide et al. on Nov. 25, 1975 and titled "Injection Molded Boots," describes a boot formed of a stretchable cloth base with a patterned or printed resin layer thereover, coated by a transparent resin layer. Mahide et al. do not show a puttee sewn to a molded footwear cover, and disclose a completely closed sole, unlike the open sole of the present footwear and lower leg covering. Also, Mahide et al. are silent regarding the provision of a laterally symmetrical footwear cover for fitting either the left or right foot equally well, as provided by the present invention.

U.S. Pat. No. 4,010,558, issued to John G. Slusher on Mar. 8, 1977 and titled "Golf Rubber Overshoe," describes a golf overshoe with spikes on the sole. Slusher does not show a molded footwear cover with an open sole, nor a laterally symmetrical shoe.

U.S. Pat. No. 4,057,853, issued to Larry A. McLane on Nov. 15, 1977 and titled "Snake Leggings," shows snake-proof leggings made of steel mesh. The leggings are of the same material for both the foot covering and legging portions, unlike the different materials used for those components of the present invention. McLane does not show a molded footwear cover, and is silent regarding any symmetrical or universal fit for left and right feet, as provided by the present invention.

U.S. Pat. No. 4,599,812, issued to Wayne A. Harmsen on Jul. 15, 1986 and titled "Leggings," describes leggings made of a single piece of material. Harmsen does not show a molded footwear cover having an open sole, and notes that left and right foot and leg articles may be formed by reversing the blanks used in constructing the articles. The present covering and protector is symmetrical and universal for both left and right feet.

U.S. Pat. No. 4,967,491, issued to Howard Plotkin on Nov. 6, 1990 and titled "Disposable, Collapsible Overshoe," describes a disposable overshoe. Plotkin does not show a molded footwear cover having an open sole, nor any symmetrical construction providing for a universal fit on both left and right feet using a single form, as provided by the present covering.

U.S. Pat. No. 5,170,503, issued to George H. Hightower, Jr. et al. on Dec. 15, 1992 and titled "Snake Protective Leggings," describes leggings formed of mesh or screen material. Hightower, Jr. et al. do not show a molded footwear cover having an open sole, or any component extending substantially below the ankle.

U.S. Pat. No. 5,311,676, issued to Thomas S. Hughes et al. on May 17, 1994 and titled "Changeable Shoe Covering," describes a stretch cover for covering a woman's shoe. The device completely covers the sole of the shoe, unlike the open sole of the present covering. Hughes et al. do not show a molded footwear cover having a puttee sewn thereto, and are silent regarding provision of a symmetrical unit for universal fit of both left and right feet or shoes, as provided by the present covering.

U.S. Pat. No. 5,337,491, issued to Lawrence L. Mascotte on Aug. 16, 1994 and titled "Shoe Covering Members," describes a shoe cover having an upper part that attaches to a lower part. The lower part is sealingly engageable with the sole of the shoe. The Mascotte cover requires a specially adapted shoe therewith, to provide for sealing the cover to the edge of the shoe sole, unlike the present covering and protector. Since the Mascotte cover is adapted to seal to the edge of the shoe sole, and shoes are customarily constructed in pairs with each shoe being a mirror image of the opposite shoe, Mascotte obviously forms his covers asymmetrically to fit either a left or right shoe, unlike the symmetrical construction of the present covers and protectors. Also, Mascotte does not show a molded footwear cover having a puttee sewn thereto, as provided by the present covers.

U.S. Pat. No. 5,469,637, issued to James R. Adam on Nov. 28, 1995 and titled "Rain Leggings," describes protective leggings that only cover the front of the lower leg and the top front of the foot. Adam does not show a molded footwear cover that covers the heel of the shoe. Also, Adam notes on column 3, lines 41 and 42, that his "Leggings . . . can be shaped to approximate left and right shoes", whereas the present foot cover and protector is symmetrical for fitting both left and right shoes.

U.S. Design Pat. No. Des. 210,190, issued to Richard J. Garcia on Feb. 20, 1968 and titled "Sportsman's Leg Protector," illustrates a leg protector or legging. Garcia does not show a molded footwear cover.

U.S. Design Pat. No. Des. 281,739, issued to Willie J. Hazley on Dec. 17, 1985 and titled "Shoe Protector," illustrates a shoe protector that does not cover the toe of the shoe. Hazley does not show a molded footwear cover that completely covers the shoe upper. However, the Hazley protector includes a portion which fits under the heel of the shoe, unlike the present protector. The Hazley design appears to be asymmetrical, requiring a mirror image for each foot.

U.S. Design Pat. No. Des. 306,921, issued to Venico Pettinelli on Mar. 27, 1990 and titled "Combined Ankle And Shin Protector," shows a legging type device with a depending extension over the outer ankle bone. Pettinelli does not show a molded footwear cover, and his protector is asymmetrical, unlike the present symmetrical protector and cover.

U.S. Design Pat. No. Des. 322,354, issued to Joseph M. Tully on Dec. 17, 1991 and titled "Protective Cover For An Athletic Shoe," illustrates a shoe protector that covers the bottom of the toe of the shoe. Tully does not show a molded footwear cover that completely covers the shoe upper, nor any form of puttee or legging extending upwardly therefrom, as provided by the present cover and protector.

U.S. Design Pat. No. Des. 341,475, issued to Hiromi Ikezawa on Nov. 23, 1993 and titled "Shoe Cover," illustrates a shoe cover for a woman's shoe. Ikezawa does not show a molded footwear cover having a puttee sewn thereto, and includes a portion passing under the sole of the shoe at the instep portion, unlike the present invention.

U.S. Design Pat. No. Des. 354,615, issued to Pamela A. Parker on Jan. 24, 1995 and titled "Half Chap Leg Covering," illustrates a lower leg covering in the form of a half chap, i. e., with each individual leg covering being separate from one another. Parker does not show a molded footwear cover that covers the footwear upper.

U.S. Design Pat. No. Des. 365,667, issued to Thomas H. Hargrove et al. on Dec. 26, 1995 and titled "Leg Protector," shows protective leggings that only cover the front of the lower leg and the top front of the foot. Hargrove et al. do not show a molded footwear cover that covers the heel or toe of the shoe.

U.K. Patent Application Number 2,103,069 A by Peter James Smith, dated Feb. 16, 1983 and titled "Sporting Overshoes," describes a golf overshoe with spikes on the sole, somewhat like the overshoe of the U.S. '558 patent to Slusher discussed further above. Smith does not show a molded footwear cover with an open sole or a symmetrical cover, as provided by the present invention.

U.K. Patent Application Number 2,226,943 A by Ellis Frith et al., dated Jul. 18, 1990 and titled "Chain Saw Protective Leggings, Trousers And Jackets," describes protective leggings which prevent injury to a wearer's legs from a chain saw. Frith et al. do not show a molded footwear cover that covers the upper of the shoe, as provided by the present cover and protector.

U.K. Patent Application Number 2,245,477 A by Jung-Hui Ho, dated Jan. 8, 1992 and titled "A Protective Half Sleeve Or Legging," describes a protective legging. Ho does not show a molded footwear cover that covers a shoe upper, nor is his sleeve or legging openable along one side, as in the present invention.

European Patent Application Number 0,411,524 A2 by Costantino Ursella, dated Feb. 6, 1991 and titled "Overshoe For Footwear Particularly For Fishing," describes an overshoe with a non-slip sole. Ursella does not show a molded footwear cover having an open sole, as in the present cover and protector.

Finally, International Application Number WO 96/15691 by Clive Neal Taylor-Haasz, dated May 30, 1996 and titled "Overshoes," describes a protective overshoe that surrounds the sole of the shoe. Taylor-Haasz does not show a molded footwear cover having an open sole, as in the present cover and protector.

None of the above inventions and patents, taken either singly or in combination, is seen to describe the instant invention as claimed.

SUMMARY OF THE INVENTION

The present invention is directed to a molded plastic or rubber shoe or boot cover sewn to a flexible fabric upper spat or puttee configured to cover bare or trousered legs, providing protection for the legs and shoes of a user of the invention while using a string trimmer, mower, chainsaw, or other implement which may discharge material back toward the operator. The present protective footwear and lower leg covering is universal, in that each unit is laterally symmetrical to provide for wear on either the left or right foot, without regard for specific left or right foot use. The footwear cover has an open sole, so the article may be donned without need for the wearer to stand, other than to pass a securing strap beneath the sole of the shoe, or to slip the toe of the shoe into a toe pocket at the front of the footwear cover. Both the footwear cover and the legging or puttee secure completely around the foot and lower leg of the wearer, thus insuring complete protection from thrown objects (sticks, stones, chips, etc.) or paint while painting.

Accordingly, it is a principal object of the invention to provide a footwear and lower leg covering which reduces the risk of damage to the wearer's clothing and footwear from activities such as mowing, using a string trimmer or chainsaw, and/or painting.

Another object of the invention is to provide a footwear and lower leg covering which provides protection from insect bites and stings for the wearer's lower leg, ankles, and feet.

It is another object of the invention to provide a lower leg and footwear covering which can be donned over the wearer's clothing, without need for removal of any clothing or footwear.

A further object of the invention is to provide a lower leg and footwear covering which includes an open sole for the footwear cover portion, which footwear cover portion is secured about the wearer's shoe by either a strap which passes beneath the sole of the shoe, or by a toe pocket or hold at the forward end of the footwear covering.

An additional object of the present invention is to provide a lower leg and footwear covering which is symmetrical, with a universal shape for wearing on either the left or right foot and lower leg of the user as desired.

Still another object of the present invention is to provide a lower leg and footwear covering which may include a knee pad portion extending upwardly from the lower leg covering portion of the device.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
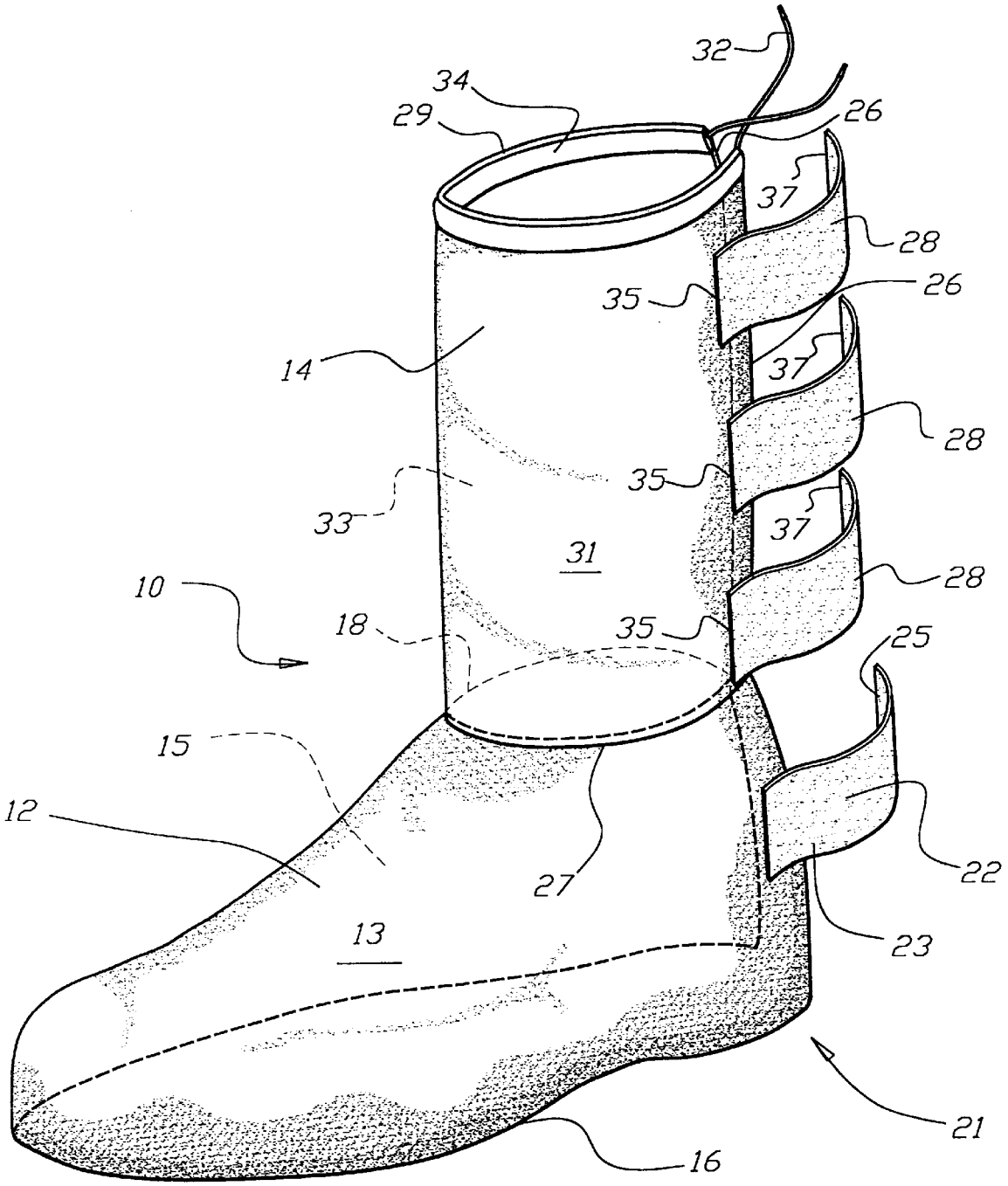
FIG. 1 is a left side perspective view of the assembled protective footwear and lower leg cover of the present invention.
Figure 2:
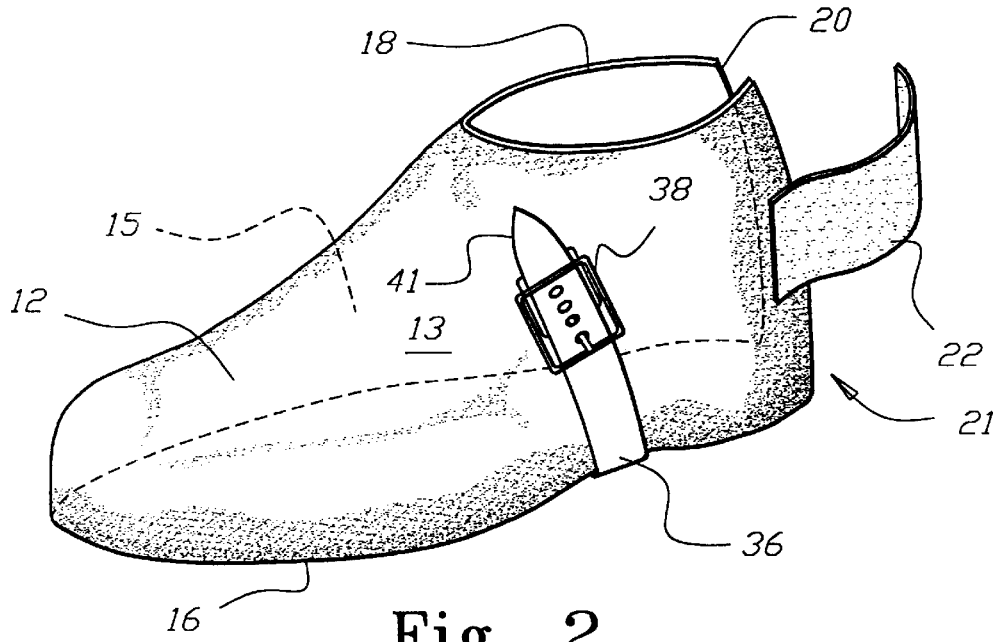
FIG. 2 is a left side and top perspective view of the molded footwear cover portion of the present invention.
Figure 3:
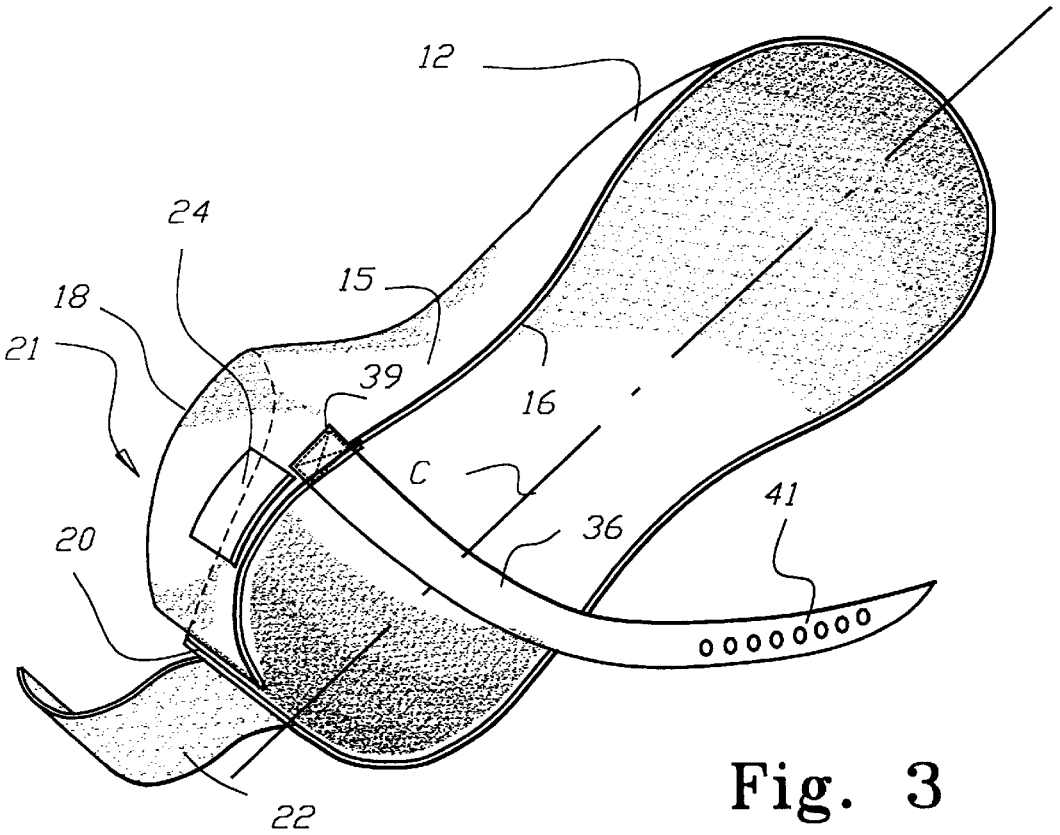
FIG. 3 is a bottom perspective view of a first embodiment of the molded footwear cover of the protective footwear and lower leg cover of the present invention, showing the open sole and strap.
Figure 4:
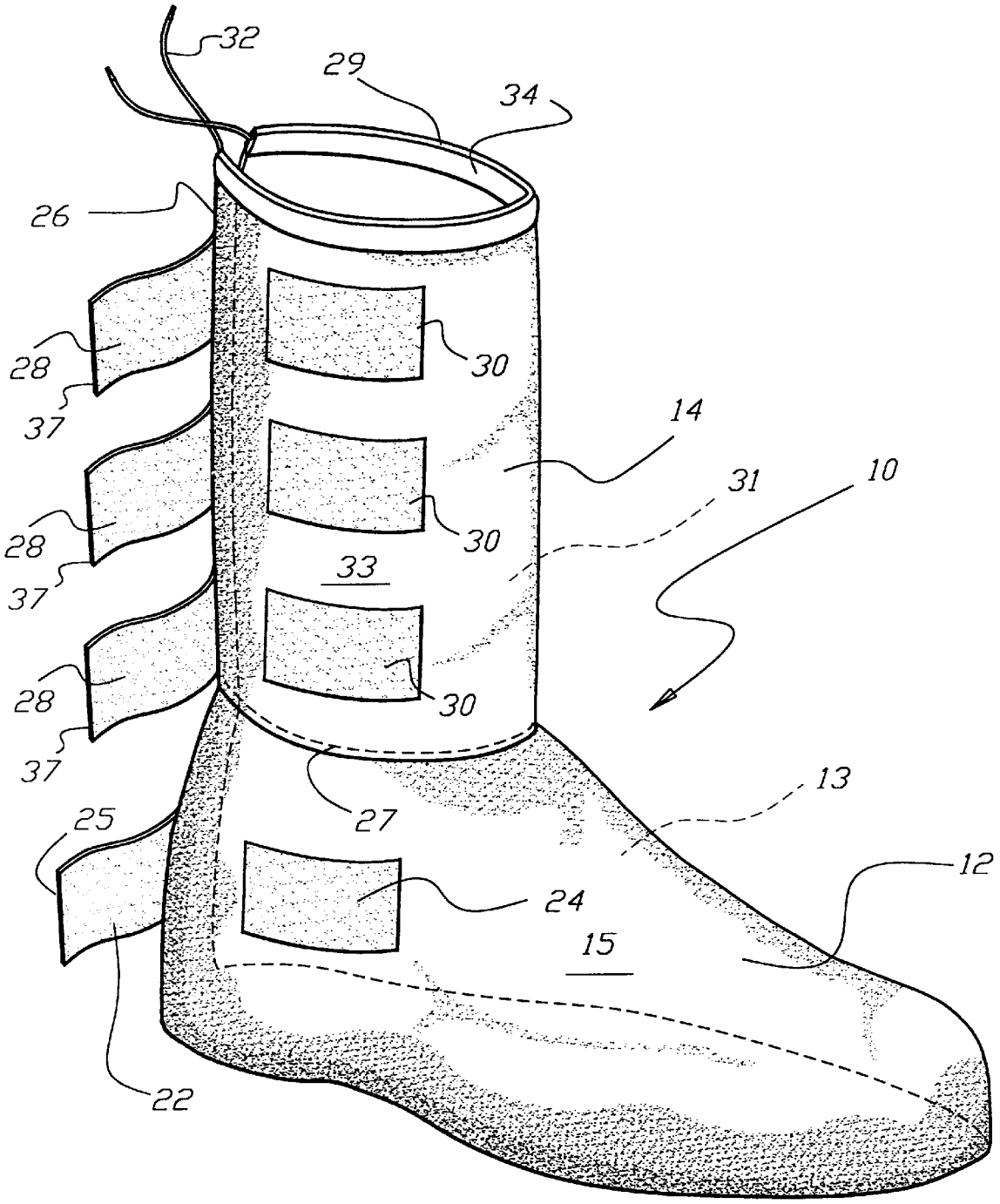
FIG. 4 is a right side perspective view of the protective footwear and lower leg cover of the present invention, showing the hook-and-loop fasteners.
Figure 6:
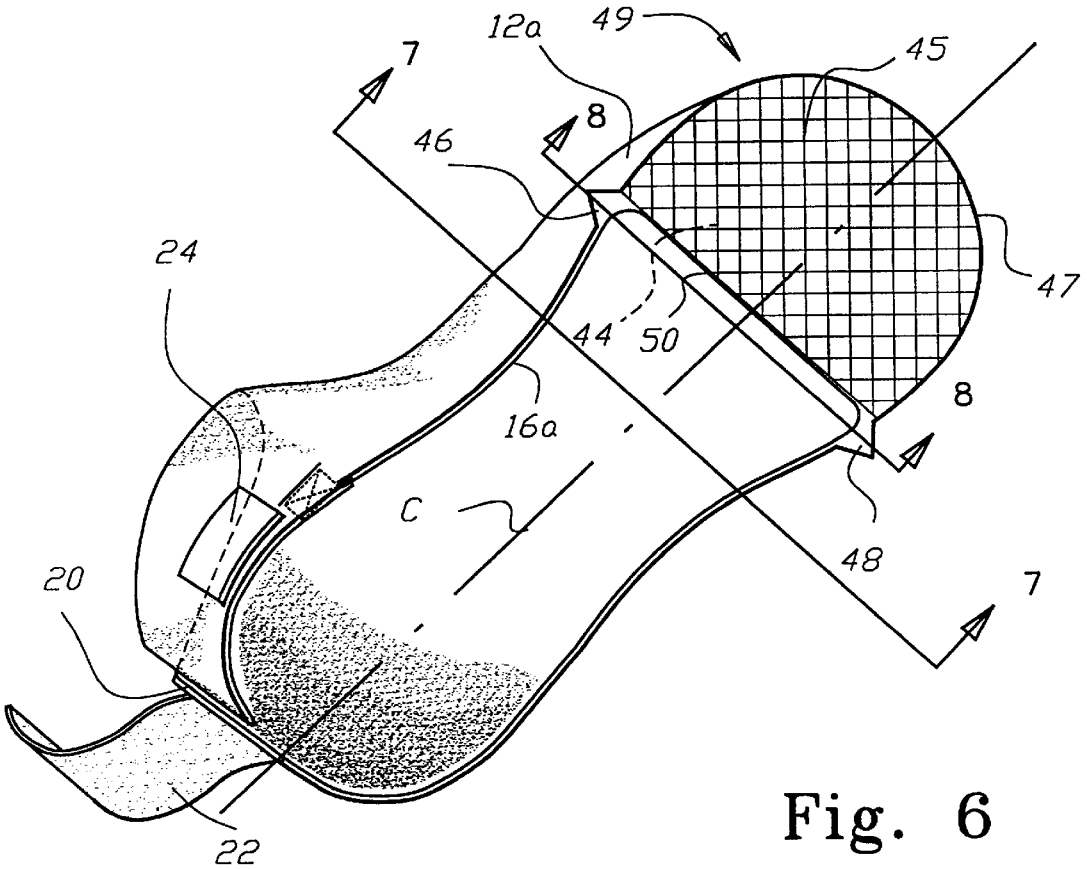
FIG. 6 is a bottom and right side perspective view of another embodiment of the molded footwear cover of the protective footwear and lower leg cover of the present invention, showing a toe pocket or hold enclosing the open sole around the toe region of the molded footwear cover.

Referring to FIGS. 1 through 4, the present invention is a protective footwear and lower leg covering 10 for the lower leg and foot. The protective covering 10 includes a resilient molded footwear cover 12, and a spat portion or puttee 14. The molded footwear cover 12 is shaped to follow the contours of a footwear upper and is sized to fit over most footwear items, including boots; a range of sizes may be provided, depending upon the precision of fit desired. It should be noted that the fit will not be as precise as that normally found in shoes, boots, and other footwear, as the present protective footwear cover 12 is laterally symmetrical about the centerline C, as indicated in FIGS. 3 and 6, with a first side 13 and opposite second side 15 disposed to each side of the centerline C. This allows the footwear cover portion 12 to have a universal fit upon either a left or a right shoe, boot, or other footwear for user convenience.

The molded footwear cover 12 has an open sole 16 so as to allow the sole of the footwear, over which the protective cover 10 is worn, to be exposed. The molded footwear cover 12 also has a top or ankle opening 18. The top opening 18 is at about ankle height and the wearer's ankle passes through the top or ankle opening 18, when the protective covering 10 is being worn by the wearer.

The footwear cover 12 includes a slit 20 (FIGS. 2 and 3) extending from the open sole 16 to the top opening 18 along the back of the heel region 21 of the molded footwear cover 12. This slit 20 is centered along the centerline C of the footwear cover 12, between the first and second sides 13 and 15 of the heel region 21. Because the molded footwear cover 12 is resilient, the two sides 13 and 15 of the heel region 21 adjacent the slit 20, can be spread apart to a width wider than the width of the slit 20 in the relaxed state. With the slit 20 spread wide apart, the ankle region of a wearer's shod foot can pass through the slit 20. Thus the slit 20 facilitates donning of the protective covering 10.

A heel strap 22, having a first end 23 and an opposite second end 25, is fixed at its first end 23 to the first side 13 of the heel portion 21 adjacent the slit 20. The second end 25 of the heel strap 22 is releasably securable to the opposite second side 15 of the heel portion 21, on the opposite side of the slit 20. The heel strap 22 helps to secure the molded footwear cover 12 over the wearer's footwear by preventing the inadvertent spreading of the slit 20 which could lead to the molded footwear cover 12 slipping off the wearer's foot and footwear.

In the illustrated example, a hook and loop fastener system is used to releasably secure the second end of the heel strap 22. A pad 24 of either hook or loop type material is carried on the side of the slit 20 opposite the side to which the first end of the strap 22 is fixed, while material of a type complementary to the material of the pad 24 is affixed to the second end of the strap 22.

The molded footwear cover 12 is preferably formed of a semi-rigid, flexibe or resilient polyvinyl chloride (PVC) or other plastic derivatives or synthetic or natural rubber or elastomer. The molded footwear cover 12 can be produced by vacuum forming, injection molding, or any other well known, suitable molding process.

The puttee 14 is in the form of a hollow sleeve having a first or lower open end 27 and an opposite second or upper open end 29. The puttee 14 is also at least generally laterally symmetrical, with a first side 31 and an opposite second side 33, and is preferably fabricated from some form of woven material, such as cotton or linen duck, or mesh reinforced polyethylene. Whatever material is chosen, the material should preferably be somewhat heat resistant and/or flame retardant. The heat resistant and flame retardant properties may be obtained by chemically treating the material, or the material may inherently have the desired heat resistant and flame retardant properties.

The puttee 14 is sewn or otherwise affixed to the molded footwear cover 12 such that the first open end 27 of the puttee 14 is contiguous with the top or ankle opening 18 of the molded footwear cover 12. The puttee 14 also has a rearwardly disposed slit 26 extending from the first or lower open end 27 of the puttee 14 to the second or upper open end 29 of the puttee 14. The slit 26 of the puttee 14 is aligned and continuous with the rearward or heel region slit 20 of the molded footwear cover 12. The seam between the puttee 14 and the molded footwear cover 12 can be sealed in a well known manner so as to be waterproof if desired. The puttee 14 can have a variety of lengths. The puttee 14 may extend from the top opening 18 of the molded footwear cover 12 to anywhere between a location below the belly of the gastrocnemius (calf) muscle and a location just below the knee.

A plurality of fastening straps 28 are distributed along the length of the puttee 14. Each of the straps 28 has a first end 35 and an opposite second end 37, with the first end 35 being affixed to the first side 31 of the puttee 14 adjacent the slit 26. The second end 37 of each of the straps 28 is releasably securable to the second side 33 of the puttee 14, on the other side of the slit 26. The plurality of straps 28 are used to secure the protective covering 10 to a wearer's lower leg. In the illustrated example, a hook and loop fastener system is used to releasably secure the second end 37 of each of the straps 28. A plurality of pads 30, corresponding in number to the straps 28, of either hook type or loop type material are carried on the side of the slit 26 opposite the side to which the first ends 35 of the straps 28 are fixed. Material of a type complementary to the material of the pads 30 is carried proximate the second end of each of the straps 28.

The protective covering 10 can also include a drawstring 32 which, when drawn tightly around the wearer's lower leg, can sealingly gather the top open end 29 of the puttee 14 around the lower leg. A tubular sleeve 34 extends along the perimeter of the second or top open end of the puttee 14, and the drawstring 32 passes through this tubular sleeve 34 to function as described above.

An optional securement strap 36 can also be attached at a first end 39 to the molded footwear cover 12 as illustrated in FIGS. 2 and 3. The strap 36 is positioned to pass under the sole of the footwear over which the molded footwear cover 12 is being worn, just ahead of the heel. A first end 39 of the strap 36 is affixed to one side of the footwear cover 12, e. g., to the second side 15, adjacent the open sole portion 16, while the opposite second end 41 of the strap 36 is releasably securable to the opposite side, e. g. the first side 13, of the footwear cover 12. In the illustrated example a buckle 38 is used to secure the releasible end 41 of the strap 36, however any suitable fastening means including hook-and-loop type fasteners may also be used.

Figure 5:
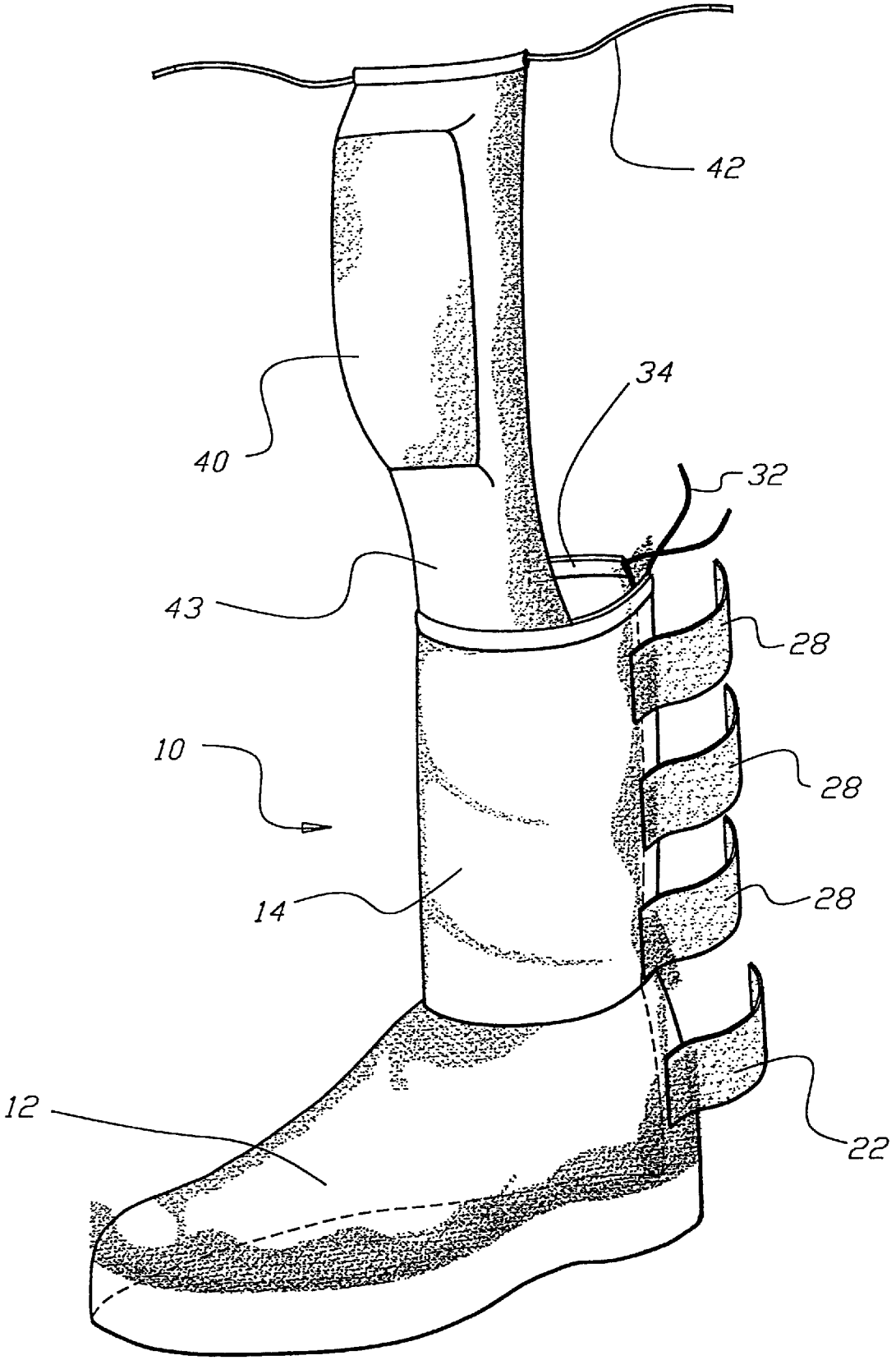
FIG. 5 is a left side perspective view of a further embodiment of the protective footwear and lower leg cover of the present invention, showing a knee pad extending upwardly from the lower leg covering.

Referring to FIG. 5, an optional flexible guard 43 including a knee pad 40 may also be provided for the protective cover 10. The guard 43 would be attached to the puttee 14 above the tubular sleeve 34. A second drawstring 42 provided above the knee pad 40 could be used to secure the knee pad 40 in position in front of the knee. The second drawstring 42 would be tied around the wearer's thigh just above the knee. When performing kneeling chores, a person may experience pain when kneeling on hard surfaces, or on hard or sharp objects. Also, performing kneeling chores can result in staining or soiling of the clothing in the knee area. The optional knee pad 40 would protect the knees and the knee area of clothing when performing kneeling chores such as weeding and planting.

Figure 7:
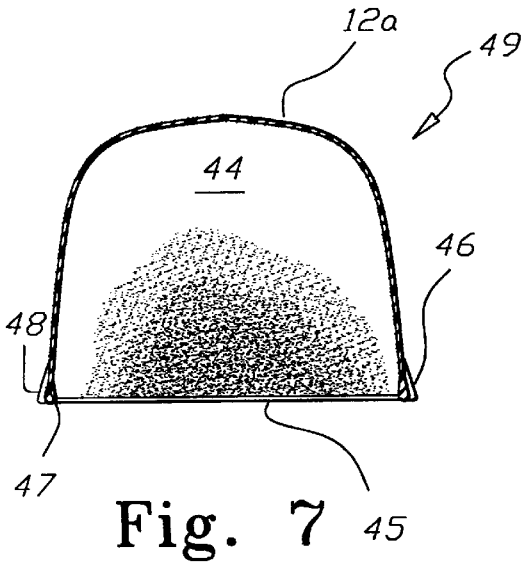
FIG. 7 is a cross sectional view of the molded footwear cover along line 7—7 of FIG. 6.
Figure 8:
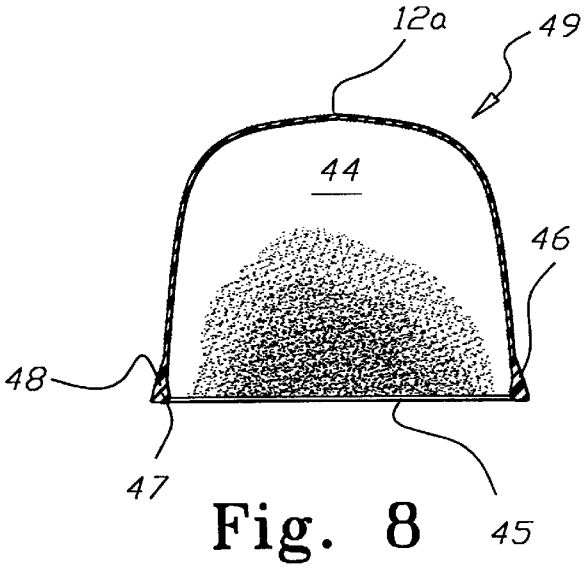
FIG. 8 is a cross sectional view of the molded footwear cover along line 8—8 of FIG. 6.

Referring to FIGS. 6–8, an alternative embodiment of the molded footwear cover 12*a* for use with the protective covering of the present invention can be seen. The molded footwear cover 12*a* incorporates a toe hold or pocket 44. The toe hold 44 obviates the need for the strap 36, but use of the strap 36 in combination with the toe hold 44 is contemplated as being within the scope of the present invention. The molded footwear cover toe hold or pocket 44 is defined by a substantially planar partial sole toe surface 45 extending across the lower periphery 47 of the forward portion 49 of the footwear cover 12*a*, and the forward portion 49 itself. Thus, the toe hold or pocket 44 passes under the toe portion of the user's footwear when the protective covering incorporating the molded footwear cover 12*a* is being worn, to secure the footwear cover 12*a* about the footwear of the wearer.

A pair of reinforcement bosses 46 and 48, one on each side of the molded footwear cover 12*a*, are provided as reinforcements to prevent tearing of the toe hold 44 away from the upper part of the molded footwear cover 12*a*. The bosses 46 and 48 are formed by thickened portions of the molded footwear cover 12*a* located at the juncture of the rearward edge 50 of the sole toe surface 45 and the perimeter or edge 47 of the forward portion 49 of the footwear cover 12*a*. The bosses 46 and 48 are roughly tetrahedrally shaped and extend for a predetermined distance up either side of the upper part of the molded footwear cover 12*a*. The toe hold 44 and the bosses 46 and 48 are preferably molded in one piece along with the rest of the molded footwear cover 12*a*, although they may alternatively be attached to the upper part of the molded footwear cover 12*a* using an adhesive. The molded footwear cover 12*a* is attached to the puttee 14 in the same manner as the molded footwear cover 12.

In summary, the present protective footwear and lower leg covering embodiments provide much improved safety and security for a person working with equipment such as mowers, string trimmers, chain saws, brush cutters, and painting. The essentially sealed configuration of the covers from the shoe or boot sole upward along the lower leg, preclude injury or damage to the shoes, boots, or clothing of the wearer, and also preclude the entry of insects which may bite or sting. The present cover will prove its value in a single work session of painting, when paint is typically spattered on clothing and shoes, boots, or other footwear. The symmetrical configuration of the present cover, particularly the footwear cover portion, allows a wearer to affix the devices to either shoe or boot and leg, without regard to left or right orientation. The materials from which the present protector and cover are formed, are relatively inexpensive, yet durable to provide for use over a long period of time. The present covers and protectors will pay for themselves in a very few uses, through savings in wear and tear on shoes, boots, and clothing of the user.

It is to be understood that the present invention is not limited to the embodiments described above, but encompasses any and all embodiments within the scope of the following claims.

I claim:

1. A protective footwear and lower leg covering for protecting a wearer's lower leg, ankle, and footwear, with the footwear including an upper portion with external contour and a sole, comprising:

a laterally symmetrical molded footwear cover portion formed of resilient material for generally fitting the external contour of the footwear, and for universally fitting both left and right footwear;

said footwear cover portion further having a forward portion with a lower periphery, with a partial sole toe surface extending thereacross to define a toe pocket between said forward portion of said footwear cover portion and said partial sole toe surface for securing said footwear cover portion about the footwear of the wearer, and a completely open sole portion extending rearwardly from said partial sole toe surface, for exposing the sole of the footwear therethrough, wherein said partial sole toe surface has a rearward edge including a reinforcement boss disposed respectively at said first and said second side of said footwear cover portion;

said footwear cover portion further including a first side and an opposite second side;

said footwear cover portion further including an ankle opening and a heel region;

said heel region having a generally vertical slit extending downwardly from said ankle opening to said open sole portion, between said first side and said second side of said footwear cover portion;

said slit comprising means for donning said footwear cover portion upon the footwear of the wearer, by resiliently spreading apart said first and said second side of said heel region to each side of said slit and inserting the footwear between said first and said second side of said footwear cover portion;

said heel region further including releasably securable slit closure means;

a puttee portion formed of a woven material and comprising a hollow sleeve having an upper open end and an opposite open lower end;

said lower end of said puttee portion being secured to said ankle opening of said footwear cover portion;

said puttee portion further having a first side and an opposite second side;

said puttee portion further including a rearward slit extending from said upper end to said lower end between said first side and said second side, and communicating with said slit of said heel region of said footwear cover portion; and said puttee portion further including releasably securable slit closure means.

2. The protective footwear and lower leg covering according to claim 1, wherein said puttee portion is sewn to said footwear cover portion.

3. The protective footwear and lower leg covering according to claim 1, wherein:

said releasably securable slit closure means of said heel region comprises a heel strap having a first end affixed to said first side of said heel region, and an opposite second end including means for releasably securing to said second side of said heel region, for closing said slit for securing said footwear cover portion about the footwear of the wearer; and said releasably securable slit closure means of said puttee portion comprises a plurality of puttee securing straps each having a first end affixed to said first side of said puttee portion adjacent said slit, and an opposite second end including means for releasably securing to said second side of said puttee, for closing said slit for securing said puttee portion about the lower leg of the wearer.

4. The protective footwear and lower leg covering according to claim 1, wherein said open upper end of said puttee portion includes a peripheral tubular sleeve, with a drawstring passing through said tubular sleeve for gathering said open upper end of said puttee for sealing about the lower leg of the wearer.

5. The protective footwear and lower leg covering according to claim 1, wherein said resilient material of said footwear covering portion is selected from the group consisting of polyvinyl chloride plastic, other plastic, natural rubber, and synthetic rubber.

6. The protective footwear and lower leg covering according to claim 1, wherein said woven material of said puttee portion is flame retardant, and is selected from the group consisting of cotton and linen duck and mesh reinforced polyethylene plastic.

* * * * *